US005137165A

United States Patent [19]

Friman

[11] Patent Number: 5,137,165

[45] Date of Patent: Aug. 11, 1992

[54] FRAMEWORK MEANS FOR COLLECTING PIECES OF A VARYING, UNSYMMETRICAL AND IRREGULAR FORM, PREFERABLY FROZEN ANIMAL CARCASSES

[75] Inventor: Erik A. Friman, Märsta, Sweden

[73] Assignee: Cool Carriers Svenska AB, Danderyd, Sweden

[21] Appl. No.: 773,558

[22] PCT Filed: Feb. 21, 1991

[86] PCT No.: PCT/SE91/00132

§ 371 Date: Nov. 7, 1991

§ 102(e) Date: Nov. 7, 1991

[87] PCT Pub. No.: WO91/14629

PCT Pub. Date: Oct. 3, 1991

[30] Foreign Application Priority Data

Mar. 20, 1990 [SE] Sweden ..... 9001001

[51] Int. Cl.[5] ..... B65D 85/68

[52] U.S. Cl. ..... 217/36; 217/43 A; 206/511

[58] Field of Search ..... 217/36, 43 A, 43 R, 217/42, 45; 206/511, 599, 600

[56] References Cited

U.S. PATENT DOCUMENTS

| | | | |
|---|---|---|---|
| 2,312,202 | 2/1943 | VanGreen | 217/36 |
| 2,661,837 | 12/1953 | McCracken | 217/36 |
| 2,970,712 | 2/1961 | Carpenter | 217/36 |
| 3,645,389 | 2/1972 | Castraux | 217/36 |
| 4,664,282 | 5/1987 | Chan | 217/36 |

*Primary Examiner*—Joseph M. Moy

*Attorney, Agent, or Firm*—Merchant & Gould, Smith, Edell, Welter & Schmidt

[57] ABSTRACT

The invention relates to a framework means for collecting, preferably, frozen animal carcasses and similar pieces of goods, including a wooden crate and strapping means. The novelty resides in the feature that in the crate, which comprises a bottom frame (1), end pieces (9), and a top frame (12), the end piece (9) extremities engaging the bottom frame (1) and the top frame (12) are arranged laterally non-displaceable, and that there are defined abutments or hooking means (14) for the strapping means (13) extending diagonally and serving as struts bracing the crate, there also being strapping means (15) enclosing the end pieces (9) and the load and preventing together with the load the end pieces (9) from bending outwardly.

2 Claims, 2 Drawing Sheets

FRAMEWORK MEANS FOR COLLECTING PIECES OF A VARYING, UNSYMMETRICAL AND IRREGULAR FORM, PREFERABLY FROZEN ANIMAL CARCASSES

TECHNICAL FIELD

This invention relates to frameworks for collecting pieces of goods or parts, preferably of a varying, unsymmetrical, and irregular form, such as frozen animal carcasses and the like.

PRIOR ART

From PCT SE 80/oo587 a framelike device is known which is used for stabilizing a number of frozen animal carcasses composing a load unit. Said device exerts a stabilizing effect on the collection of parts or individual pieces, which are otherwise held together by a tightenable baglike enclosure.

Even if the complete load unit can be handled per se by means of a fork truck after having been turned over onto one side where a pair of reinforcement ribs are provided, such units are not able to be readily stacked, so if stacking is requested they are placed in specific frames or crates having rigid ends and vertical corner struts. The known frameworks for holding a load together are comparatively complicated to operate as they request that several manual operations be carried out before use.

The fact that the known framework arrangements cannot be stacked but need to be placed in special frames of baskets brings with it an undesired dependence on a specific type of storing and handling system. Besides the support jig wherein the wooden framework means and the bag enclosure is placed during the loading operation, specific spacing ribs and a specific turnover equipment have to be mounted and in addition to this there are support frames of support baskets. The known framework means also requires, besides loading and handling personnel, access to personnel for mounting the fork handling ribs after that the bag enclosure has been tightened and straps applied.

OBJECT OF THE INVENTION

The invention has for its object to provide, starting from the known art, an improved framework means for goods which besides consuming a minimum of wood is simple to mount, easy to load, cover and strap and which has such a stability in loaded and ready condition that it is capable of carrying on top of it—without the support of auxiliary frames of baskets—at least two similarly loaded framework means.

SUMMARY OF THE INVENTION

The invention is based on cooperation between a framework or crate and strapping means enclosing the crate. As is well known woodwork has a good capacity of assuming compressive stresses if these are directed correctly in relation to the longitudinal fibre direction of the wood, and if the wood is stabilized laterally so that bending or buckling thereof is prevented. In wood structure it is also important that the junction points. i.e. in this case the corners, are arranged such that the connected unit becomes stable and controlled and so that the connection does not affect adversely the strength of the wood.

Transverse cross bars are secured by means of nailing or screwing to a pair of wooden rods forming a bottom frame, said cross bars serving as spacing means towards the basis or floor. At the ends of the rods upwardly open, socket like brackets are secured wherein the lower extremities of a pair of end pieces are inserted, the top extremities of said end pieces being inserted into similar socket like brackets on a pair of top rods. Hereby a closed frame or crate is formed where the extremities of the end pieces are firmly enclosed and guided by the sockets of the brackets. After putting the load inside the crate, which is stabilized during loading by means of external support members, straps are provided enclosing the crate and the load therein, parallel to the bottom frame of the crate as well as diagonally thereof. The crate and the strapping, in cooperation with the load which serves as holding-up means, create a lateral stabilizing of the uprights of the end pieces, making it possible to utilize maximally the ability of said uprights to carry compressive forces along the fibre direction.

Features characterizing the invention are disclosed in the accompanying claims.

DESCRIPTION OF EMBODIMENTS

Figure 1:
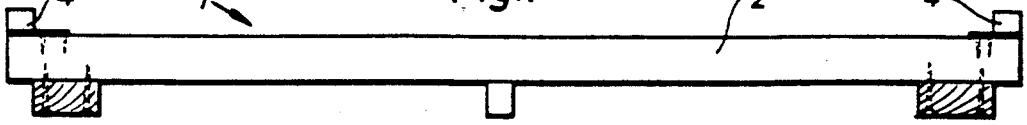
Figure 2:
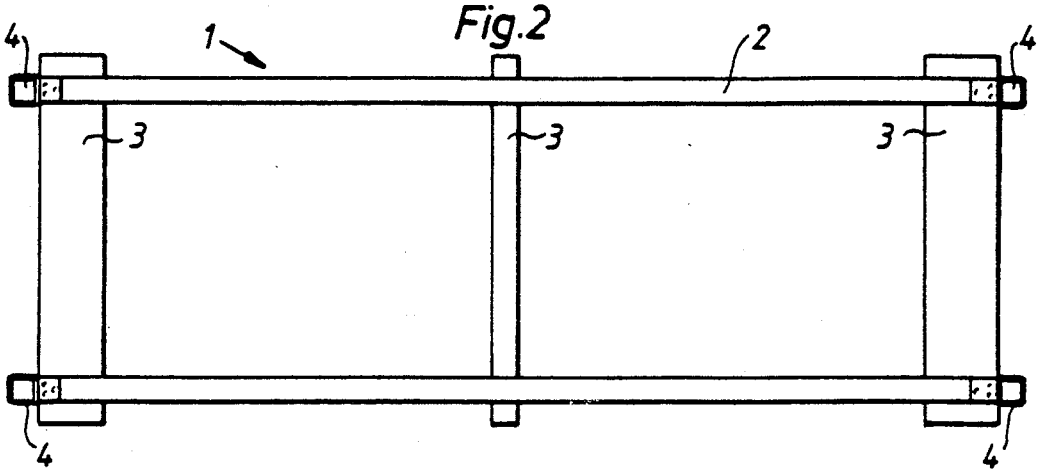
Figure 4:
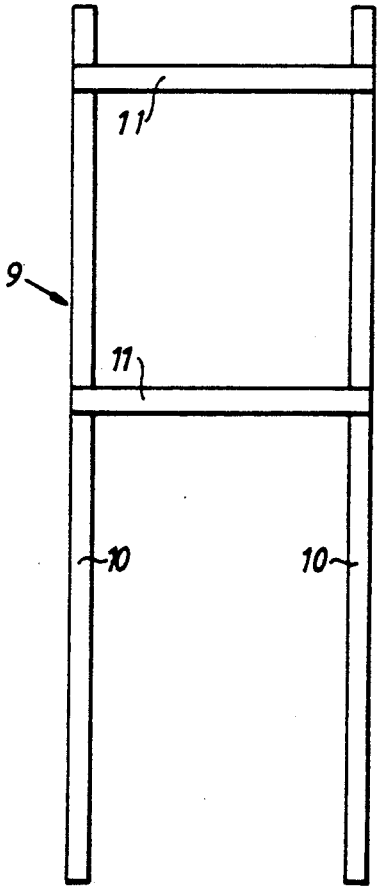
Figure 3:
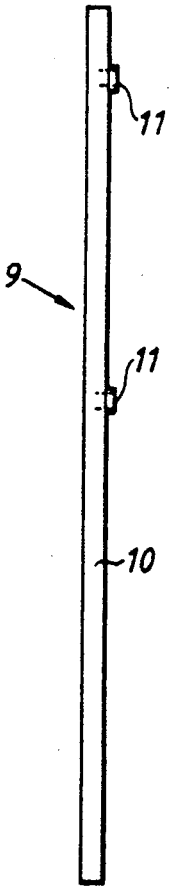
Figure 5:
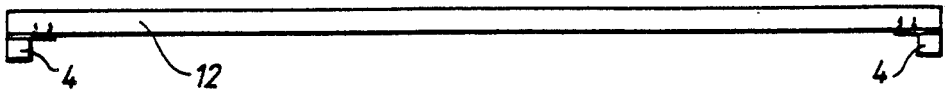
Figure 6:
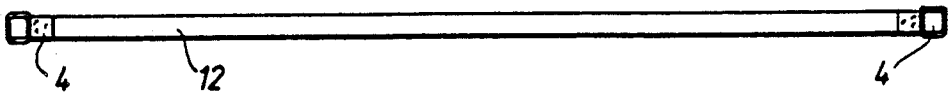
Figure 7:
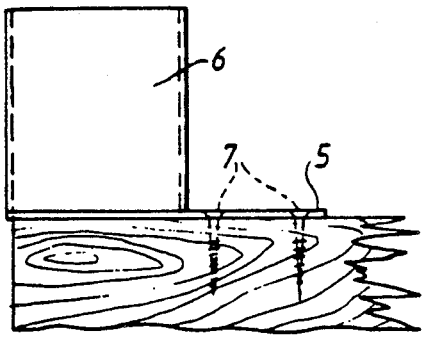
Figure 8:
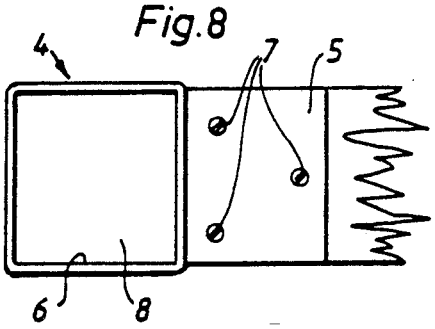
Figure 9:
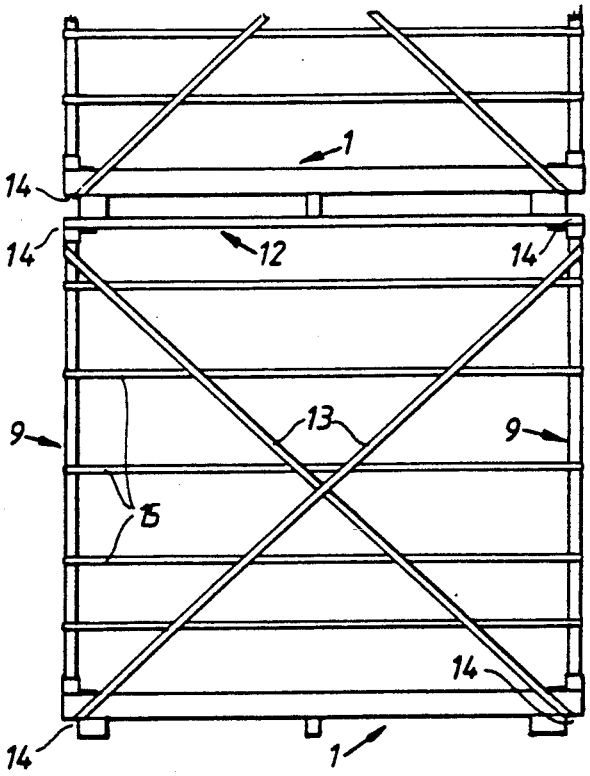

An embodiment of the device according to the invention will be described in the following with reference to the accompanying drawings, wherein FIGS. 1 and 2 show a supporting bottom frame in elevation and top view, respectively, FIGS. 3 and 4 show one of the end pieces in elevation and endwise, FIGS. 5 and 6 show one part of the top frame in elevation and bottom view, FIGS. 7 and 8 show, on a larger scale, an end portion cut out from the bottom frame or the top frame, in elevation and top view of, alternatively, bottom view, and FIG. 9 shows, on a smaller scale, a loaded and strapped framework means in accordance with the invention with a further unit stacked thereon.

The parts component of the framework means for loading goods are all of a simple and uncomplicated nature.

The bottom frame 1 comprises two horizontal bars or rods 2 approximately 75 mm in height and 50 mm in width, and on the underside of these rods cross bars 3 are secured to serve as spacing means and to make fork-lift handling possible, the two outer cross bars being wider than the central one. The outer cross bars are spaced from the ends of the horizontal rods 2 so that these ends projects outwardly a little. On the top side of the respective end of the bars a bracket 4 is provided.

The bracket 4 comprises a mounting plate 5 and a socket 6 of rectangular cross section extending from said plate. The bracket is secured by screws or nails, as indicated at 7 at the ends of the horizontal bars, and there are also nail or screw holes 8 in the socket 6.

Each end frame 9—only one is shown in greater detail—comprises two comparatively thin uprights 10, suitably of a cross section 50×50 mm, and these uprights are united by means of transverse struts 11, whereof an upper strut is provided a short distance below the top ends of the uprights 10, whereas the other strut, or as the case may be, the other struts can be placed substantially arbitrarily below.

The top frame is not a frame in the proper meaning of the word but is formed of two separate rods 12, suitably having the same cross section as the uprights 10, and these rods 12 are provided at their ends with brackets 4 identical with the brackets 4 on the bottom frame 1.

The inside dimension of the socket 6 of the bracket 4 is adjusted to the cross section of the end frame uprights 10, which means that the ends or extremities of said uprights can be inserted into said sockets.

During loading of the crate this has to be supported laterally by a supporting jig, now shown, comprising a bottom plate and two upstanding end pieces, preferably displaceable laterally and between which the bottom frame 1 is placed initially. The lower ends of the uprights 10 of the end frame 9 are inserted into the bracket sockets 6 of the bottom frame 1, after which the upper ends of said uprights are connected by means of the top frame rods 12, whose sockets 6 are slipped onto the top ends of the uprights 10. After the sockets being secured to the ends of the uprights by means of nails or screws through the holes 8 the crate is ready for use.

The goods is placed as compactly as possible on the bottom frame 1 and between the end frame 9, all the way up to the top frame, so that the space of the crate is filled up as completely as possible.

Thereupon a plastic foil or sheeting is wrapped around the crate, to which end the central portion of the sheeting may lie initially on the bottom frame 1, the rest of it being folded along the frame during loading to then be arranged with overlapping ends at the top. At the same time a second sheeting could be applied perpendicularly to the first sheeting in order to cover the end portions of the loaded crate.

While the loaded crate remains in the support jig a series of strappings are arranged having the function, on the one hand, to maintain the load in its intended position within the crate and, on the other hand, and primarily, to bring about staying and bracing of the crate so that the intended lateral stability be imparted to the same.

Here the crate and the strapping arrangement cooperates to prevent the weak uprights 10 from being bent out when loading acts vertically, for example, when one or some further loaded crates are placed upon the first one. Hereby it is not only the strapping arrangement which contributes to the desired lateral support, but to a certain extend also the load itself does so in those cases it consists of solid objects, such as frozen animal carcasses and the like. The diagonally crossing strapping means 13 have a very essential function, viz., to prevent the crate from folding up in one direction or the other.

Safe and slipping preventing hooking points 14 for the diagonal straps 13 are formed by the outer cross bars 3 of the bottom frame 1 being retracted within the ends of rods 2 and the upper strut 11 being arranged a little bit below the top ends of the respective upright 10. When the diagonal strapping means 13 have been mounted and firmly pulled home and, in addition, the horizontal straps 15 have been mounted, crate and load will form a very stable unit which—thanks to the fact that the uprights 10 of the end frames 9 are supported laterally, outwardly as well as inwardly, along practically their whole length—is capable of caring very large loads. It is possible without consequence to stack three loaded crates according to the invention one upon the other, each weighing about 1.5 ton.

As stresses exerted on the crate when handling and stacking the same are assumed as thrust along the uprights and as tension in the strapping means there is no need for heavy demands upon the quality of wood, which reduces the costs in comparison with loading material requesting classified wood. Preparing the components of the crates can take place, generally speaking, wherever sawngoods of the requested dimensions are at hand, for example, 50×50 and 75×50. The only specific accessory is the bracket which guides the extremities of the end frames in relation to the bottom and top frames, but neither this bracket is any difficult to manufacture. The shown bracket design is only one of many, and the bracket can be designed in many various ways with its function maintained. What is essential is that it forms a stable lateral support for the upright ends at bottom frame and top frame.

I claim:

1. A framework means for collecting pieces of goods of a varying, unsymmetrical, and irregular form, preferably frozen animal carcasses, including a crate made of wood or similar material and strapping means connecting the pieces of goods with the crate, characterized in that the wooden crate comprises a lower frame (1) provided on its underside with spacing blocks or bars (3), end pieces (9) resting on the ends of said bottom frame, and a top frame (12) connecting the top extremities of said end pieces, where the end piece (9) extremities engaging the bottom frame (1) and the top frame (12) are arranged laterally non-displaceable by means of sockets or similar members (4) embracing said end piece extremities, that abutments of hooking means (14) for strapping means (13) are provided at the spacing blocks on the bottom frame (1) and at transverse struts (11) on the end pieces (9), said strapping means extending diagonally and serving as bracing means for the crate to prevent deforming and folding up thereof under load, and that a number of strapping means (15) are provided essentially parallel with the bottom frame (1) enclosing the end pieces (9) of the crate and the load located therebetween, said last mentioned strapping means offering, in corporation with the load serving as holding-up means, a stabilizing effect on the end pieces rendering it possible that such loaded crates be stacked one upon the other.

2. A framework means according to claim 1, characterized in that the members (4) preventing the end piece extremities from being laterally displaced in relation to the bottom and top frames comprise sockets (6) to be secured to the ends of the respective frame, said sockets having an internal cross section adjusted to the cross section of the uprights (10) of the end pieces.

* * * * *